US010358832B1

(12) United States Patent
Wagner

(10) Patent No.: US 10,358,832 B1
(45) Date of Patent: Jul. 23, 2019

(54) SHELF APPARATUS FOR A LADDER

(71) Applicant: Charles Michael Wagner, Urbana, OH (US)

(72) Inventor: Charles Michael Wagner, Urbana, OH (US)

( * ) Notice: Subject to any disclaimer, the term of this patent is extended or adjusted under 35 U.S.C. 154(b) by 101 days.

(21) Appl. No.: 15/671,380

(22) Filed: Aug. 8, 2017

Related U.S. Application Data

(60) Provisional application No. 62/375,933, filed on Aug. 17, 2016.

(51) Int. Cl.

| | |
|---|---|
| ***E04G 5/00*** | (2006.01) |
| ***E06C 7/14*** | (2006.01) |
| ***E06C 5/32*** | (2006.01) |
| *E04G 1/00* | (2006.01) |
| *E04G 3/00* | (2006.01) |

(52) U.S. Cl.
CPC ..... *E04G 5/003* (2013.01); *E06C 5/32* (2013.01); *E06C 7/14* (2013.01); *E04G 1/00* (2013.01); *E04G 3/00* (2013.01)

(58) Field of Classification Search
CPC ..... E06C 7/00; E06C 7/14; E06C 7/16; E06C 7/165; E06C 7/48; E06C 7/143; E06C 5/32; E04G 5/003; E04G 1/00; E04G 3/00; A47G 7/044
USPC ..... 108/47, 109, 157.1, 157.12, 157.13, 108/157.18, 159.11
See application file for complete search history.

(56) References Cited

U.S. PATENT DOCUMENTS

| | | | | | |
|---|---|---|---|---|---|
| 407,079 | A * | 7/1889 | Laskey | E06C 7/16 | 182/121 |
| 446,472 | A * | 2/1891 | Roberts | A47B 57/565 | 248/245 |
| 931,265 | A * | 8/1909 | Bucco | E06C 1/32 | 182/120 |
| 1,015,123 | A * | 1/1912 | Bauer | E06C 7/16 | 182/107 |
| 1,143,678 | A * | 6/1915 | Winans | E06C 7/16 | 248/238 |
| 1,493,036 | A * | 5/1924 | Hay | A47B 31/06 | 108/47 |
| 1,518,099 | A * | 12/1924 | Neiswender | A47B 31/06 | 108/47 |

(Continued)

FOREIGN PATENT DOCUMENTS

| | | | | |
|---|---|---|---|---|
| EP | 0931905 | A3 | 5/2000 | |
| EP | 2169241 | A1 * | 3/2010 | B62J 1/08 |

*Primary Examiner* — Katherine W Mitchell
*Assistant Examiner* — Shiref M Mekhaeil
(74) *Attorney, Agent, or Firm* — Mark Navarre

(57) ABSTRACT

A shelf apparatus configured for temporary attachment to a ladder deployed in a working position includes a planar tray supported at its inboard end by a rung or top plate of the ladder, left and right support arms pivotably attached to opposite sides of the tray near its inboard end, a rigid linkage coupling the tray to the left and right support arms, and an adjustable clamping mechanism for clamping the tray to the rung or top plate. In use with a straight ladder, the tray is horizontally suspended under the inclined frame of the deployed ladder, the support arms are raised to rest against the inclined rails of the ladder above the tray, the rigid linkage vertically supports the tray from the support arms, and the clamping mechanism secures the tray to the rung.

10 Claims, 5 Drawing Sheets

(56) References Cited

U.S. PATENT DOCUMENTS 1,576,034 A * 3/1926 Butt ..... A47B 5/04 108/134
1,593,834 A * 7/1926 McNeal ..... A47B 31/06 108/47
2,043,312 A * 6/1936 Warner ..... E06C 7/16 182/113
2,056,078 A * 9/1936 Slater ..... A47B 57/34 108/107
2,174,891 A * 10/1939 Maran ..... E06C 7/16 182/121
2,175,572 A * 10/1939 Ruhl ..... A47B 1/00 108/157.1
2,236,717 A * 4/1941 Noack ..... D06F 81/06 108/33
2,252,025 A * 8/1941 Olson ..... E06C 7/16 108/149
2,388,142 A * 10/1945 Harris ..... E04G 3/18 182/130
2,498,428 A * 2/1950 Kruse ..... A47B 5/04 108/135
2,500,559 A * 3/1950 Miller ..... E06C 7/16 182/121
2,767,897 A * 10/1956 Hoffman ..... E06C 1/32 182/116
2,787,508 A * 4/1957 Math ..... A47B 31/06 108/47
2,867,401 A * 1/1959 Sheahan ..... A47C 7/68 108/47
3,249,073 A * 5/1966 Gorham ..... A47B 57/045 108/134
3,422,923 A * 1/1969 Lund ..... E06C 7/14 182/120
4,212,371 A * 7/1980 Gaviorno, Jr. ..... E06C 7/16 182/121
4,261,435 A * 4/1981 Winter ..... B25H 3/06 182/121
4,280,590 A * 7/1981 Polizzi ..... E06C 7/48 182/107
4,401,187 A 8/1983 Van Patten
4,480,810 A * 11/1984 Hall ..... E06C 7/14 182/129
4,492,169 A * 1/1985 Ware ..... A47B 57/52 108/108
4,541,344 A * 9/1985 Nichols ..... A47B 47/028 108/108
4,542,874 A * 9/1985 Ronning ..... E06C 7/16 182/121
4,575,149 A * 3/1986 Forestal ..... A47C 7/68 108/135
4,620,489 A * 11/1986 Albano ..... A47B 96/025 108/105
4,696,373 A * 9/1987 Page ..... E06C 7/16 182/121
5,020,757 A * 6/1991 Sulecki ..... E04G 1/30 248/238
5,022,541 A * 6/1991 White ..... A47F 5/103 108/108
5,060,755 A * 10/1991 Bourdages ..... E06C 7/16 182/121
5,170,720 A * 12/1992 Scheurer ..... B60N 3/002 108/132
5,170,810 A * 12/1992 Chapin ..... A61H 3/00 108/47
5,191,954 A 3/1993 Ledford
5,368,267 A * 11/1994 Howard ..... A47G 7/044 248/208
5,429,205 A * 7/1995 Collins ..... E06C 7/14 182/122
5,460,241 A * 10/1995 LaBelle ..... E06C 7/16 182/121
5,641,142 A 6/1997 Hanson et al.
5,653,178 A * 8/1997 Huczka ..... A47B 5/04 108/135
5,655,740 A * 8/1997 Lazarus ..... A47B 57/30 108/108
5,692,712 A * 12/1997 Weinschenk, Jr. ..... A47B 21/0314 108/108
5,694,292 A * 12/1997 Paulsel ..... G06F 1/1632 108/108
5,727,649 A 3/1998 Buckley
5,738,319 A * 4/1998 Grassi ..... A47G 7/044 248/215
5,803,422 A 9/1998 Buchler
5,806,817 A 9/1998 Loud
5,842,253 A 12/1998 Ahl et al.
5,909,922 A * 6/1999 Dugas ..... A47C 7/70 108/43
5,931,257 A * 8/1999 Harden ..... E04G 5/10 182/90
5,979,336 A * 11/1999 Nottingham ..... D06F 81/06 108/42
5,992,564 A 11/1999 Kirkpatrick et al.
6,045,102 A * 4/2000 Terenzoni ..... E04D 15/00 248/238
6,390,238 B1 * 5/2002 Gibson ..... E06C 1/387 182/129
6,666,149 B1 * 12/2003 Lathrop ..... B60N 3/004 108/152
6,688,570 B1 2/2004 Mundt
6,772,987 B2 * 8/2004 Jones, II ..... A47B 97/08 248/441.1
6,796,249 B1 * 9/2004 Hiras ..... A47B 96/02 108/157.13
7,077,238 B2 7/2006 Butler et al.
7,175,061 B2 * 2/2007 Dohn ..... A45F 5/02 224/241
D576,292 S 9/2008 Brown
7,703,734 B2 * 4/2010 Chen ..... A47B 88/43 108/108
7,845,469 B1 12/2010 Butler et al.
8,047,330 B1 * 11/2011 English ..... E06C 7/48 182/117
8,201,661 B1 6/2012 O'Connell, Sr.
8,366,061 B2 * 2/2013 Rose ..... B44D 3/14 15/257.06
D683,054 S * 5/2013 Deardorf ..... D25/68
8,672,279 B2 * 3/2014 Schirmacher ..... E06C 7/14 108/26
8,701,898 B2 * 4/2014 Chai ..... A47L 15/503 211/150
8,887,645 B1 * 11/2014 Semmer ..... A47B 3/08 108/42
8,979,045 B2 * 3/2015 Petrakis ..... A47B 83/04 248/205.1
9,498,063 B2 * 11/2016 Borgen ..... A47H 27/00
9,878,649 B2 * 1/2018 Beere ..... B60N 3/001
10,001,244 B2 * 6/2018 Ziaylek ..... F16M 13/02
10,123,598 B2 * 11/2018 Achillopoulos ..... A45C 5/14
2005/0098595 A1 * 5/2005 Smith ..... B60R 9/0485 224/319
2007/0181369 A1 * 8/2007 Gibson ..... E06C 1/393 182/165
2007/0252498 A1 * 11/2007 Wing ..... F25D 25/02 312/408
2008/0053751 A1 * 3/2008 Meyers ..... E06C 7/16 182/121
2012/0211305 A1 8/2012 Moss et al.
2014/0014797 A1 * 1/2014 McSherry ..... F16B 2/12 248/231.41
2016/0353877 A1 * 12/2016 Brus ..... A47B 5/02

* cited by examiner

SHELF APPARATUS FOR A LADDER

RELATED APPLICATIONS

This application claims priority based on the Provisional Patent Application No. 62/375,933, filed Aug. 17, 2016.

TECHNICAL FIELD

This invention relates to an accessory for a straight ladder (fixed or extension) or a stepladder, and more particularly to a removable shelf apparatus that is easily usable with different types and styles of ladders.

BACKGROUND OF THE INVENTION

The need for a sturdy and easily manipulated ladder shelf attachment is evident in view of the many prior patents on the subject, mostly by individual inventors. Yet it is equally evident that none have met with much commercial success. Aside from cost, some factors contributing to this lack of commercial success include non-adaptability to different types and styles of ladders, and non-ergonomic designs that are awkward to transport, deploy and store. In other words, what is needed is a removable ladder shelf apparatus that is: (1) easily stored and transported; (2) easily installed on a deployed ladder (preferably with one hand, so that the user can maintain three support points during installation and removal of the apparatus); and (3) adapted to be used with different types and styles of ladders, including both straight ladders and stepladders, and ladders having various types and styles of rungs or steps.

SUMMARY OF THE INVENTION

The present invention is directed to an improved shelf apparatus configured for temporary attachment to a straight ladder deployed in a working position—that is, with its frame rails inclined at an appropriate angle such as 75 degrees with respect to horizontal, or alternatively, to the top plate of a self-supporting ladder such as a step-ladder. The various components of the shelf apparatus are foldable or relatively positionable in a way that allows the apparatus to be folded flat for ease of transport or storage, and to be installed on or removed from a deployed ladder with one hand, so that the user can maintain three support points on the ladder during installation and removal of the shelf apparatus.

The shelf apparatus includes a planar tray supported at its inboard end by a rung of the ladder (or the top plate of a step-ladder), adjustable front and rear clamp mechanisms mounted on the tray for clamping the inboard end of the tray to the rung (or top plate), first and second frame support arms pivotably attached to opposite sides of the tray near its inboard end, and a rigid linkage coupling the support arms to the tray. The linkage, which is preferably in the form of a smooth round wire, includes a central portion disposed under the tray, and first and second ends anchored in the first and second support arms. In use with a straight ladder that is inclined against a surface such as the side of a building, the tray is horizontally suspended under the inclined frame of the deployed ladder, the support arms rest against the rails of the inclined ladder frame above the tray, and the rigid linkage vertically supports the tray below the support arms. In use with a step ladder having a top plate, the support arms are unnecessary, and pivot downward into the plane of the horizontally deployed tray.

The front clamping mechanism includes a vertically adjustable frame and a pair of clamp legs that extend forward of the adjustable frame below the tray to engage the bottom of the rung or top plate. The rear clamping mechanism is horizontally adjustable in the plane of the tray to engage a rearward edge of the rung or top plate.

DESCRIPTION OF THE PREFERRED EMBODIMENT

As mentioned above, the shelf apparatus of the present invention is configured for temporary attachment to a ladder deployed in a working position—that is, with its frame rails inclined at an appropriate angle such as 75 degrees with respect to horizontal. The 75 degree angle of inclination is generally regarded to be the optimal angle in terms of resistance to sliding, strength of the ladder, and balance of a person climbing the ladder, and with a straight ladder, is approximately achieved by placing the feet of the rails at a distance from the support wall equal to one-fourth the working length of the ladder.

The ladder can be a straight ladder with its frame inclined against an elevated surface such as the side of a building, or a self-supported step-ladder, with or without a top plate. A straight ladder includes just a frame of two parallel rails (or joined telescoping rails in the case of an extension ladder) spanned by a set of rungs (or steps), whereas a step-ladder includes two hinged frames, joined in most cases by a rectangular top plate. With either type of ladder, the shelf apparatus of the present invention can be suspended under the inclined ladder frame(s); while with a stepladder, the shelf apparatus may alternately be fastened to the rectangular top plate.

Figure 9:
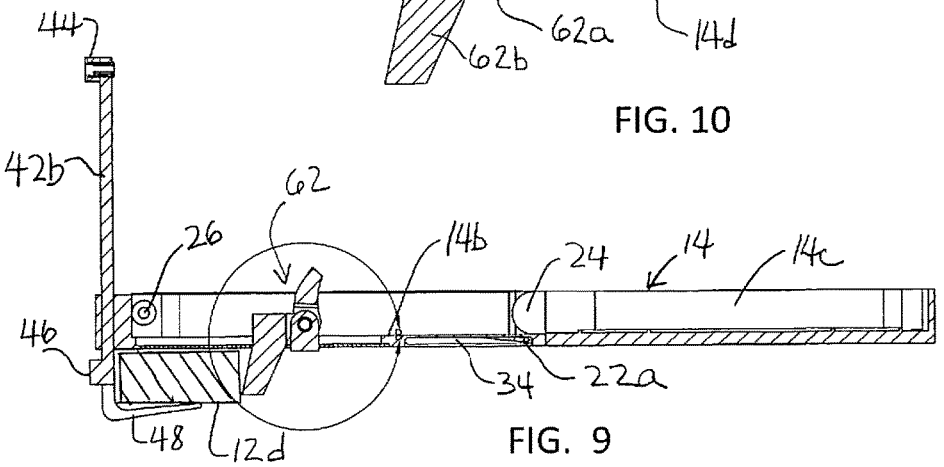
FIG. 9 is a cross-sectional view like that of FIG. 4, but without the ladder, and with the support arms lowered into the plane of the tray.

Referring to the drawings, the shelf apparatus of this invention is generally designated by the reference numeral 10. In FIGS. 1-4, the shelf apparatus 10 is depicted as installed on a inclined straight ladder 12 having a frame of two parallel rails 12*a* and 12*b* and at least one rung 12*c* spanning the rails 12*a* and 12*b*. In FIG. 9, the shelf apparatus 10 is depicted as installed on a step-ladder having a top plate 12*d*.

In general, the shelf apparatus 10 includes the following elements: a planar tray 14, left and right support arms 16 and 18 pivotably attached to opposing sides of the tray 14 near its inboard end 14*a*, adjustable front and rear clamping mechanisms 20 and 21 for clamping the inboard end 14*a* of the tray 14 to the rung 12*c* (or top plate 12*d*), and a rigid linkage 22 coupling the tray 14 to the support arms 16 and 18.

The tray 14 has a generally flat rectangular floor 14*b* that is suitable for supporting various workpieces (not shown) such as tools or paint cans or trays, a peripheral shoulder 14*c* to laterally retain such workpieces, and a sturdy front wall 15 that supports the front clamping mechanism 20. As shown, the tray 14 is divided into two hinged portions and so that it may be folded in two when not in use. Preferably, the outboard portion is nested within the inboard portion at the hinge 24, and is shorter than the inboard portion, so that the peripheral shoulder 14*c* of the outboard portion will fold flat against the floor 14*b* of the inboard portion when folded inward as permitted by the hinge 24. With the outboard tray portion in its un-folded or deployed state as depicted in the drawings, it is maintained in co-planar relationship with the inboard tray portion by virtue of the abutting edges of the inboard and outboard portions.

Figure 1:
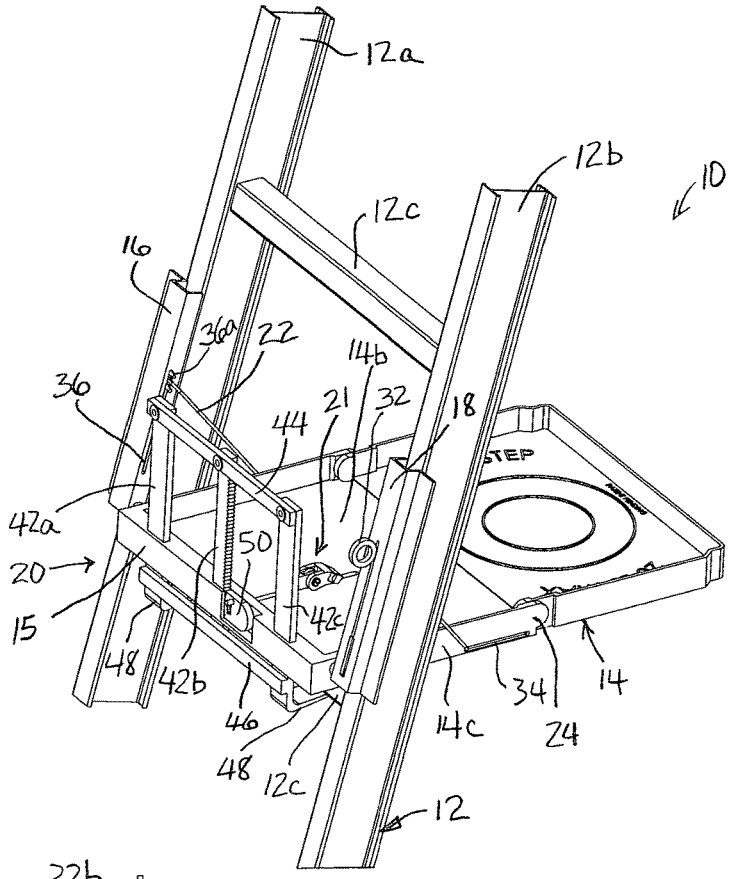
FIG. 1 is an isometric view of the shelf apparatus of this invention installed on a straight ladder.
Figure 2:
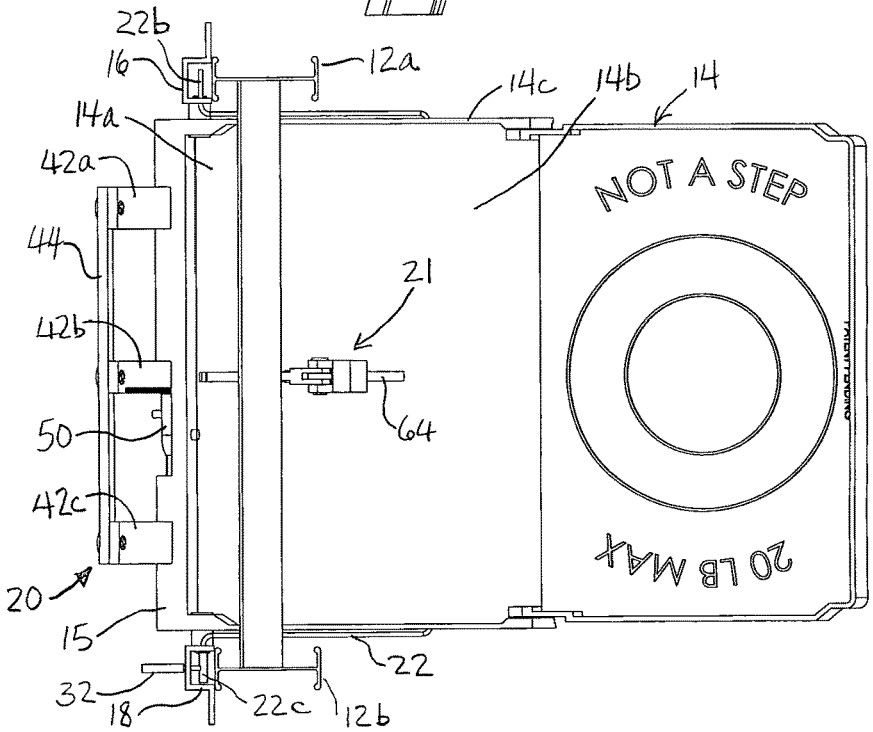
FIG. 2 is an isometric view of the shelf apparatus of FIG. 1, in line with the rails.
Figure 3:
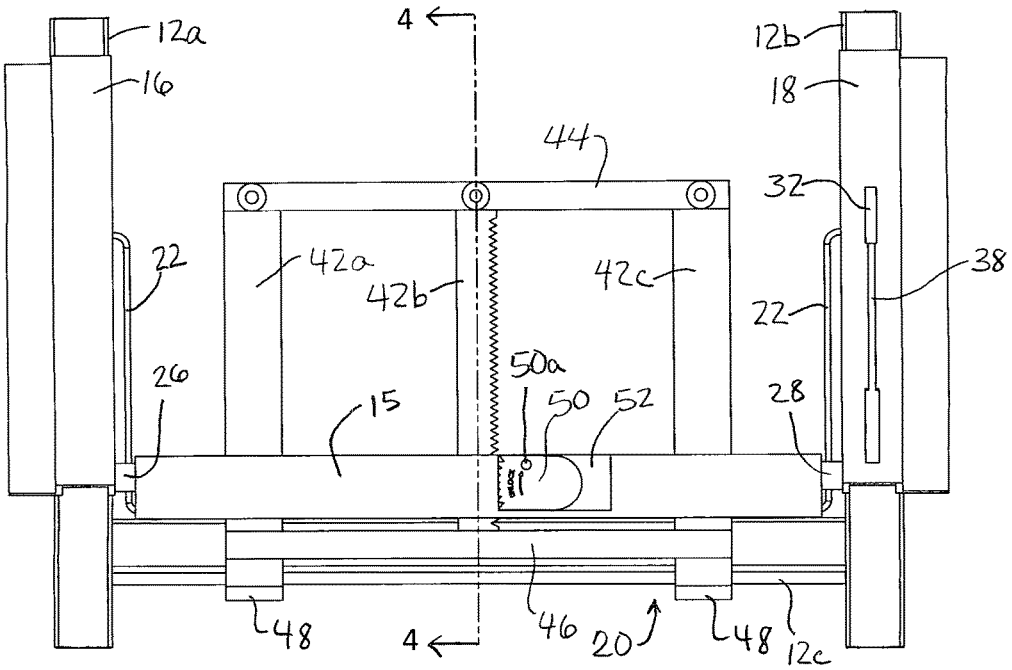
FIG. 3 is front view of the shelf apparatus of FIG. 1.
Figure 7:
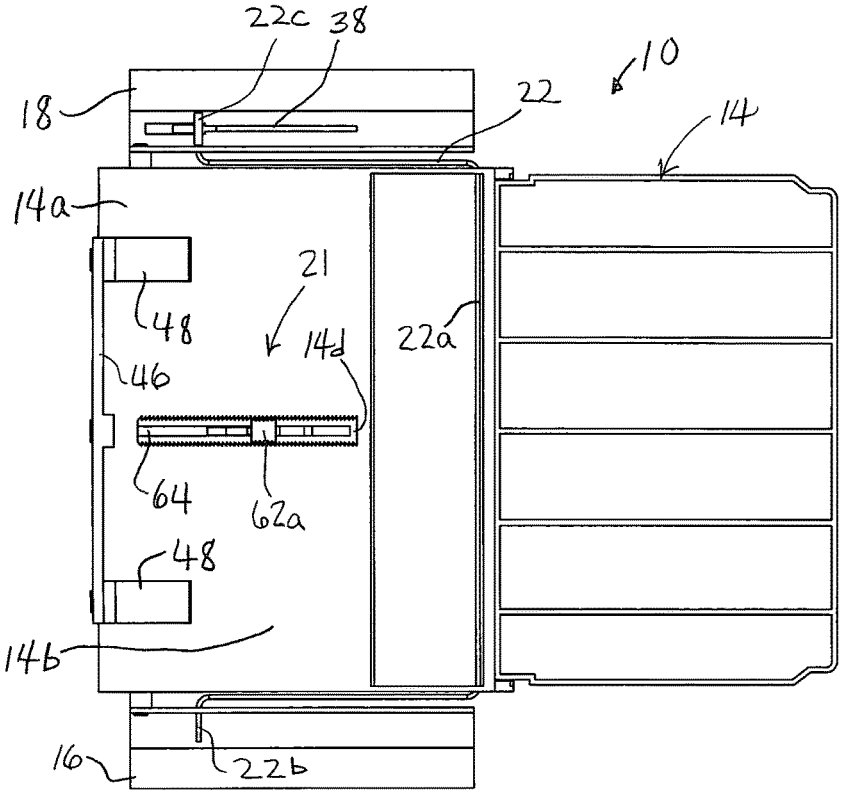
FIG. 7 is a bottom view of the shelf apparatus with the support arms lowered into the plane of the tray.
Figure 8:
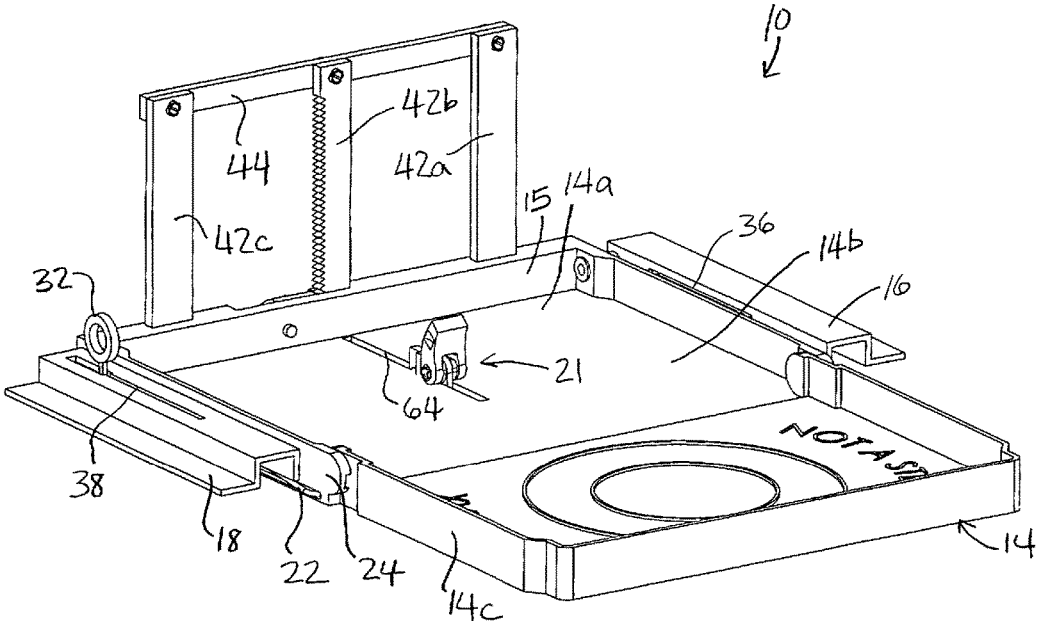
FIG. 8 is an isometric view of the shelf apparatus with the support arms lowered into the plane of the tray.

As best seen in the isometric view of FIG. 1, the support arms 16, 18 are generally U-shaped in cross-section, with a laterally outboard flange. As best seen in the partial exploded view of FIG. 5, the U-shaped portions of the support arms 16, 18 are pivotably mounted on a pair of posts 26, 28 formed on the outer periphery of the lateral peripheral shoulders 14*c* of tray 14 near its inboard end 14*a*. Consequently, the support arms 16 and 18 are constrained to planes of rotation that are parallel with the lateral peripheral shoulders 14*c* of tray 14. The widths of tray 14 and support arms 16, 18 are chosen so that the U-shaped portions of the support arms 16, 18 will rest against the inclined surface of the ladder rails 12*a* and 12*b* as depicted in FIGS. 1-4. In a storage or transport state, or when the shelf apparatus 10 is used on a step-ladder top plate 12*d*, the support arms 16 and 18 are rotated forward into the plane of the tray 14, as illustrated in FIGS. 7-9.

Figure 4:
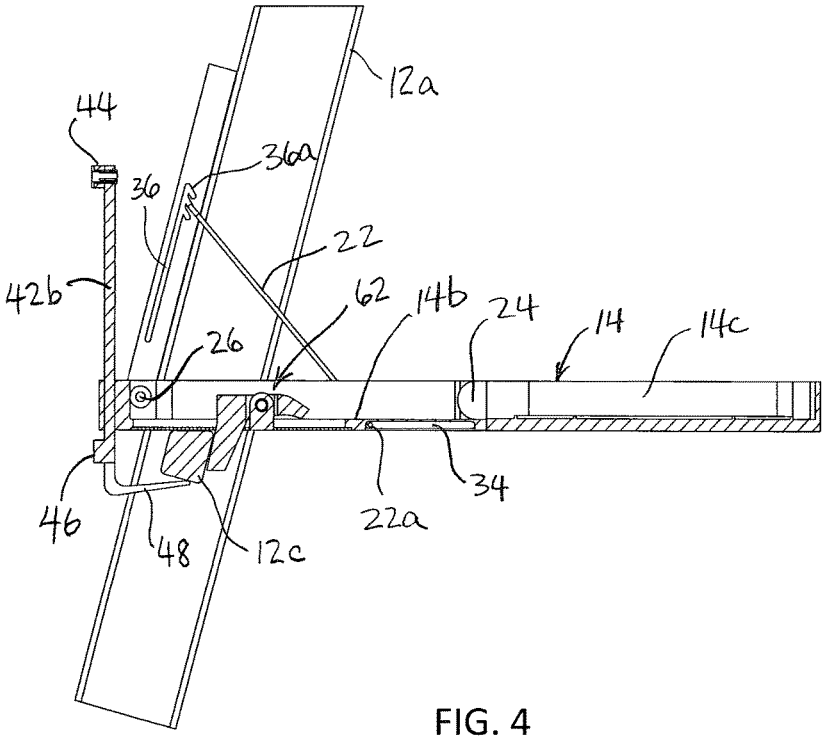
FIG. 4 is a cross-sectional view, taken along lines 4-4 in FIG. 3.
Figure 5:
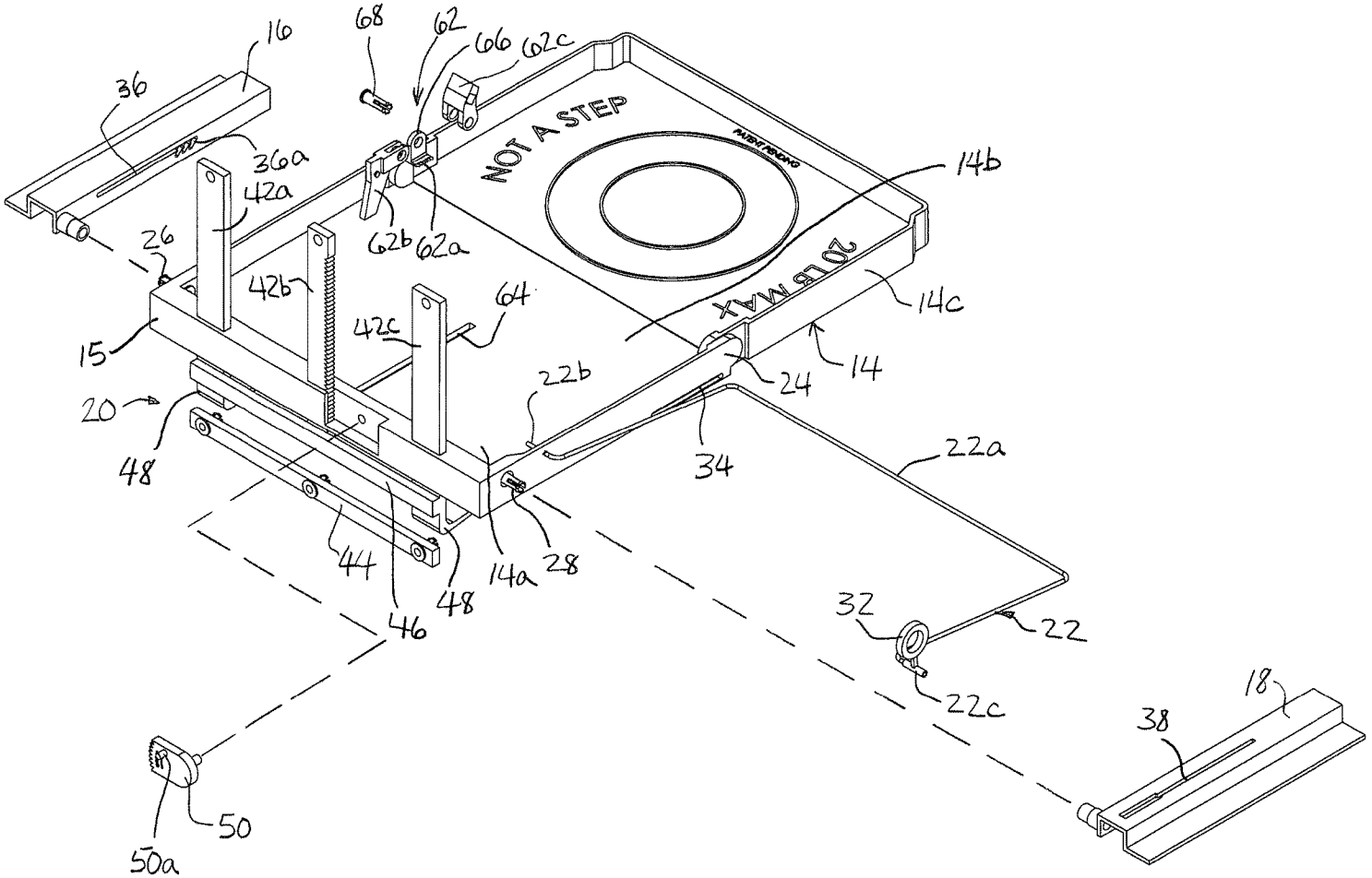
FIG. 5 is a partially exploded isometric view of the shelf apparatus of FIG. 1.
Figure 6:
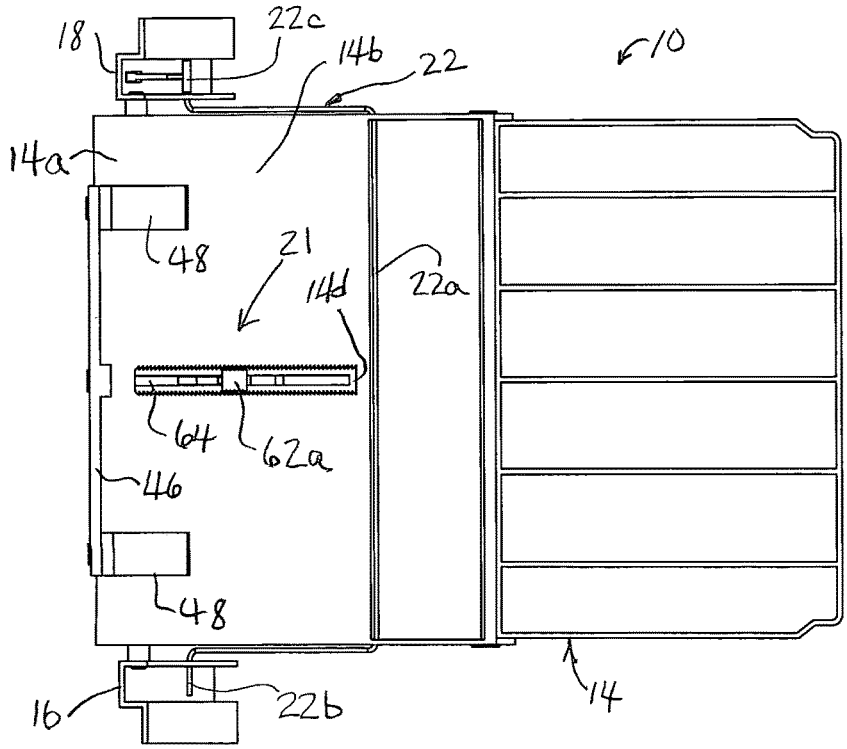
FIG. 6. is a bottom view of the shelf apparatus of FIG. 1, omitting the ladder.

As best seen in the partial exploded view of FIG. 5, the rigid linkage 22 is in the form of a smooth round wire bent into a flat U-shape with a flat bottom 22*a*, laterally extending ends 22*b* and 22*c*, with a stalk and ring-shaped knob 32 depending from the laterally extending end 22*c*. As best seen in FIGS. 4-7, the flat bottom 22*a* of the linkage 22 (that is, its central portion) is disposed under the inboard portion of tray 14, with its lateral extremities passing through slots 34 formed in the lateral peripheral shoulders 14*c* of the tray 14. And as seen in FIGS. 6-7, the bottom of tray 14 is recessed between the two lateral slots 34 to accommodate movement of the linkage 22 within the slots 34. The ends 22*b* and 22*c* of the linkage 22 pass through slots 36 formed in the laterally inboard faces of the support arm 16 and 18, respectively. And as best seen in FIG. 4 and in the partial exploded view of FIG. 5, the support arm slots 36 are provided with several notches 36*a* at their outboard ends, defining different locked angular orientations of the support arms 16, 18 that correspond to the angle of inclination of the ladder 12 when the ends 22*b* and 22*c* of the linkage 22 are seated in the notches 36*a*. When the angular orientation of the support arms 16, 18 with respect to the tray 14 matches the inclination of the ladder 12, the tray 14 will be horizontally level.

For ease in positioning the linkage 22, the stalk of knob 32 protrudes through a support arm adjustment slot 38 in the upper face of the support arm 18 so that the knob 32 may be conveniently grasped by a user. Accordingly, adjustment of the knob 32 within the slot 38 produces a corresponding adjustment of the linkage 22. In the deployed state depicted in FIGS. 1-4 and 6, the knob 32 is positioned fully forward (or nearly so) within the support arm adjustment slot 38, the support arms 16, 18 rest on the ladder rails 12*a*, 12*b*, and the flat portion 22*a* of the linkage 22 is positioned at the inboard (front) ends of the tray slots 34. In the folded state depicted in FIGS. 7-9, the knob 32 is positioned fully rearward within the support arm slot 38, the support arms 16, 18 lie in the plane of the tray 14, and the flat portion 22*a* of the linkage 22 is positioned at the outboard (rear) ends of the tray slots 34.

The front clamping mechanism 20 is slidably mounted in the front wall 15 of the tray 14, and the rear clamping mechanism 21 is slidably mounted on the floor 14*a* of the tray 14. The front clamping mechanism 20 can be adjusted vertically (that is, in a direction perpendicular to the floor 14*b* of tray 14) to engage a bottom surface of the rung 12*c* or top plate 12*d*, whereas the rear clamping mechanism 21 can be adjusted horizontally toward the front or rear of the tray 14 to engage a rear surface of the rung 12*c* or top plate 12*d*.

The front clamping mechanism 20 includes a frame of three vertical bars 42*a*, 42*b*, 42*c* passing through corresponding slots in the front wall 15 of the tray 14, an upper horizontal bar 44 fastened to the vertical bars 42*a*, 42*b*, 42*c* near their upper ends, a lower horizontal bar 46 fastened to the vertical bars 42*a*, 42*b*, 42*c* near their lower ends, and a pair of clamp legs 48 that extend longitudinally forward of the lower bar 46. The first clamping mechanism 40 serves to vertically clamp the inboard end 14*a* of the tray 14 to the ladder rung 12*c* (FIG. 4) or top plate 12*d* (FIG. 9). To this end, the front clamping mechanism 40 can be adjusted vertically, with the vertical bars 42*a*,42*b*,42*c* sliding in the slots of front wall 15, until the clamp legs 48 engage the lower surface of the ladder rung 12*c* or top plate 12*d*. As applied to a step-ladder top plate 12*d* (FIG. 9), the vertical bars 42*a*,42*b*,42*c* additionally engage the leading edge of the top plate 12*d*, and thereby serve as a horizontal stop for the inboard end 14*a* of tray 14.

The front clamping mechanism 20 also includes a toothed pawl 50 for locking in a desired vertical adjustment of the clamp legs 48. As best seen in the partial exploded view of FIG. 5, there is a rectangular recess 52 in the outboard face of the tray's front wall 15 adjacent the center vertical bar 42*b*, and the side of the bar 42*b* adjacent the recess 52 is toothed. The pawl 50 is pivotably mounted within the recess 52 so that its teeth engage those of the bar 42*b* when pivoted downward (counter-clockwise), but not when pivoted upward (clockwise). The pawl 50 includes a post 50*a* by which the user can manipulate the rotary position of the pawl 50 to lock or unlock the vertical position of the front clamping mechanism 20.

Figure 10:
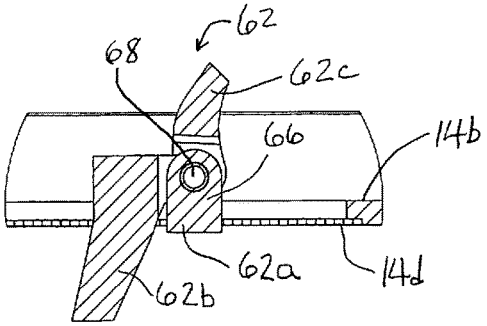
FIG. 10 is an enlarged detail view of the circled portion of FIG. 9.

The rear clamping mechanism 21 includes sliding clamp assembly, generally designated by the reference numeral 62, that is horizontally adjustable as permitted by a fore-aft slot 64 formed in the floor 14*b* of tray 14. As best seen in the bottom views of FIGS. 6-7, the slot 64 runs perpendicular to the rung 12*c* or top plate 12*d*, and there is a toothed recess 14*d* in the bottom of the tray floor 14*b* along the length of slot 64. The sliding clamp assembly 62 includes a toothed plate 62*a* that selectively engages the teeth of the recess 14*d* to lock the assembly 62 relative to the tray 14. The toothed plate 62*a* includes a tab 66 that extends through the tray slot 64, and the remaining two elements of the sliding clamp assembly 62 are pivotably mounted on a hinge pin 68 received in an aperture formed in the tab 66. These two elements are a clamp arm 62*b* extending toward the tray's inboard end 14*a*, and passing downward through the slot 64; and a user manipulated cammed lever 62*c* extending in the opposite direction above the tray floorl 4*b*. When the lever 62*c* is rotated clockwise against the floor 14*b* of tray 14 as viewed in FIGS. 1-2 and 4, the cammed periphery of lever 62*c* lifts the toothed plate 62*a*, bringing it into engagement with the teeth of the recess 14*d* to lock the assembly 62 relative to the tray 14. However, when the lever 62*c* is rotated counter-clockwise to extend upward as viewed in FIGS. 8-10, the toothed plate 62*a* is lowered out of engagement with the toothed recess 14*d*, allowing the user to position the assembly 62 within the slot 64. FIG. 4 depicts the sliding clamp assembly 62 locked, with the clamp arm 62*b* pressed against the rear or inboard face of the ladder rung 12*c*, and FIG. 9 depicts the sliding clamp assembly 62 un-locked, with the clamp arm 62*b* pressed against the rear or inboard face of a step-ladder top plate 12*d*.

In use with a straight ladder such as the ladder 12, the knob 32 is positioned forward within the slot 38 to raise the support arms 16, 18 to an inclination matching that of ladder 12, and the apparatus 10 is positioned on the ladder 12 such that the tray's inboard end 14*a* rests on the ladder rung 12*c*, and the support arms 16, 18 rest against the inclined ladder rails 12*a*, 12*b*. Then, the user releases the rear clamping mechanism 21 by rotating lever 62*c* counter-clockwise, and positions the sliding clamp assembly 62 so that the clamp arm 62*b* presses against the inboard face of the ladder rung 12*c*. Then the user locks the sliding clamp assembly 62 by rotating lever 62*c* clockwise, bringing the toothed plate 62*a* into engagement with the teeth of the tray recess 14*d*. And optionally, the front clamping mechanism 20 may be adjusted upward as depicted in FIG. 4 by simply raising it until the clamp legs 48 engage the lower surface of the ladder rung 12*c*. It will be noted that raising the frame of the front clamping mechanism 20 automatically releases the pawl 50, whereas the frame cannot be lowered without first releasing it by rotating the pawl 50 clockwise and out of engagement with the teeth of bar 42*b*.

The application to the top plate 12*d* of a stepladder is similar, except that the support arms 16,18 remain lowered in the plane of the tray 14. The apparatus 10 is positioned on the ladder 12 such that the tray's inboard end 14*a* rests on the top plate 12*d*, the front clamping mechanism 20 is adjusted upward as described above to engage the lower face of the top plate 12*d*, and the rear clamping mechanism 21 is adjusted as described above to engage the clamp arm 62*b* against the rear or inboard face of the top plate 12*d*.

In summary, the ladder shelf apparatus 10 is: (1) easily folded into a compact state for storage and transportation; (2) easily installed on a deployed ladder 12; and (3) adapted to be used with different types and styles of ladders, including both straight and free-standing ladders, and ladders having various types and styles of rungs or steps. The various elements of the shelf apparatus 10 may be constructed of metal or plastic, as appropriate, and of course, it will be recognized that while my invention has been described in reference to the illustrated embodiment, numerous modifications and variations in addition to those mentioned herein will occur to those skilled in the art, and still fall within the intended scope of my invention.

The invention claimed is:

1. A shelf apparatus for a deployed ladder having a frame of two rails spanned by a rung or top plate, the shelf apparatus comprising:

a planar tray having an inboard end adapted to rest on said rung or top plate;

an adjustable clamp mechanism mounted on said tray for clamping the inboard end of said tray to said rung or top plate;

first and second support arms pivotably attached to opposite sides of said tray at said inboard end;

a support arm adjustment slot opening in said first support arm;

a linkage coupling said support arms to said tray, said linkage including a central portion disposed under a floor of said tray, and first and second ends anchored in said first and second support arms, respectively; and a user manipulated knob fastened to the first end of said linkage and protruding through said support arm adjustment slot opening, said knob being positionable within said support arm adjustment slot opening to adjust an angle of said first and second support arms with respect to said tray.

2. The shelf apparatus of claim 1, further comprising:

peripheral shoulders bordering the opposite sides of said tray, each such peripheral shoulder having a slot opening through which said linkage passes, where such slot openings constrain movement of said linkage when said knob is positioned within the support arm adjustment slot opening on said first support arm.

3. The shelf apparatus of claim 1, where:

said first and second ends of said rigid linkage are anchored in slot openings formed on inboard lateral faces of said first and second support arms.

4. The shelf apparatus of claim 1, wherein:

said first and second support arms are pivotable upward with respect to said tray to rest against said frame above said tray whereby said tray is vertically supported by said linkage.

5. The shelf apparatus of claim 4, where:

said first and second ends of said linkage are anchored in slot openings formed on inboard lateral faces of said first and second support arms; and a plurality of notches are formed in said slot openings for receiving the first and second ends of said linkage, said notches corresponding to different angles of inclination of said frame.

6. The shelf apparatus of claim 1, further comprising:

a front wall bordering a front edge of said tray; and a front clamping mechanism slidably mounted on said front wall to allow adjustment of said front clamping mechanism in a direction perpendicular to the floor of said tray, said front clamping mechanism including at least one leg that extends under the floor of said tray, whereby said front clamping mechanism is adjustable to bring said at least one leg into engagement with said rung or top plate for clamping said tray to said rung or top plate.

7. The shelf apparatus of claim 6, further comprising:

a recess formed on a front face of said front wall adjacent said front clamping mechanism; and a pawl pivotably mounted in said recess, said pawl having a locked position in which it engages said front clamping mechanism to fix a position of said front clamping mechanism with respect to said front wall, and an un-locked position in which it is pivoted out of engagement with said front clamping mechanism to permit adjustment of said front clamping mechanism.

8. The shelf apparatus of claim 1, further comprising:

a slot opening in the floor of said tray in a direction perpendicular to said rung or top plate; and a sliding clamp assembly partially received within said slot opening for movement therein, said sliding clamp assembly including a clamp arm extending below the floor of said tray so as to engage a rear surface of said rung or top plate for clamping said tray to said rung or top plate.

9. The shelf apparatus of claim 8, where:

a toothed recess is formed on a bottom surface of the floor of said tray along a length of said slot opening; and said sliding clamp assembly includes a toothed plate mounted for movement with said clamp arm, said toothed plate having a tab that extends through said slot opening, such that vertical movement of said tab within said slot opening either engages said toothed plate with said toothed recess to fix a position of said clamp arm with respect to said tray or disengages said toothed plate from said toothed recess to allow movement of said sliding clamp assembly within said slot.

10. The shelf apparatus of claim 9, wherein said sliding clamp assembly further comprises:

a cammed lever pivotably mounted to said tab above the floor of said tray so as to control a vertical position of said tab within said slot opening for selectively engaging or disengaging said toothed plate and said toothed recess.

* * * * *